US009640291B2

(12) United States Patent
Feser et al.

(10) Patent No.: US 9,640,291 B2
(45) Date of Patent: May 2, 2017

(54) STACKED ZONE PLATES FOR PITCH FREQUENCY MULTIPLICATION

(71) Applicant: Carl Zeiss X-ray Microscopy, Inc., Pleasanton, CA (US)

(72) Inventors: Michael Feser, Orinda, CA (US); Alan Francis Lyon, Berkeley, CA (US)

(73) Assignee: Carl Zeiss X-Ray Microscopy, Inc., Pleasanton, CA (US)

( * ) Notice: Subject to any disclaimer, the term of this patent is extended or adjusted under 35 U.S.C. 154(b) by 0 days.

(21) Appl. No.: 14/068,322

(22) Filed: Oct. 31, 2013

(65) Prior Publication Data

US 2014/0126703 A1 May 8, 2014

Related U.S. Application Data

(60) Provisional application No. 61/721,659, filed on Nov. 2, 2012.

(51) Int. Cl.

| | |
|---|---|
| ***G21K 1/00*** | (2006.01) |
| ***G21K 1/06*** | (2006.01) |
| *G21K 7/00* | (2006.01) |

(52) U.S. Cl.

CPC ..... *G21K 1/00* (2013.01); *G21K 1/06* (2013.01); *G21K 7/00* (2013.01); *G21K 2201/06* (2013.01); *G21K 2201/067* (2013.01)

(58) Field of Classification Search

CPC . G01K 1/06; G01T 1/295; G01T 1/29; G21K 5/04; G21K 1/065; G21K 7/00; G21K 2201/00; G21K 2201/06; G21K 2201/061; G21K 2201/067; G21K 2207/00; G21K 2207/005; G21K 1/06; G21K 1/00; G01N 23/20; G01N 23/20008; G02B 3/08; G02B 27/12; B32B 3/18; G03B 21/60

USPC ..... 378/81, 84

See application file for complete search history.

(56) References Cited

U.S. PATENT DOCUMENTS

| | | | | |
|---|---|---|---|---|
| 5,257,132 | A | 10/1993 | Ceglio et al. | |
| 6,269,145 | B1 * | 7/2001 | Piestrup et al. | 378/81 |
| 6,917,472 | B1 | 7/2005 | Yun et al. | |
| 7,057,187 | B1 | 6/2006 | Yun et al. | |

(Continued)

FOREIGN PATENT DOCUMENTS

| | | |
|---|---|---|
| JP | 07333396 | 12/1995 |
| WO | 0165305 A1 | 9/2001 |
| WO | 2010134012 | 11/2010 |

OTHER PUBLICATIONS

Katakura Norihiro, Production of Diffraction Optical Element (JP 07333396) English Translation, Dec. 22, 1995.*

(Continued)

*Primary Examiner* — Glen Kao
(74) *Attorney, Agent, or Firm* — HoustonHogle LLP

(57) ABSTRACT

A compound x-ray lens and method of fabricating these lenses are disclosed. These compound lenses use multiple zone plate stacking to achieve a pitch frequency increase for the resulting combined zone plate. The compound equivalent zone plate includes a first zone plate having an initial pitch frequency stacked onto a second zone plate to form an equivalent compound zone plate. The equivalent zone plate has a pitch frequency that is at least twice the initial pitch frequency. Also, in one example, the equivalent zone plate has a mark-to-space ratio of 1:1.

16 Claims, 14 Drawing Sheets

(56) References Cited

U.S. PATENT DOCUMENTS

| | | | | |
|---|---|---|---|---|
| 8,526,575 | B1 | 9/2013 | Lyon et al. | |
| 2004/0069957 | A1* | 4/2004 | Menon | G03F 7/70291 378/34 |

OTHER PUBLICATIONS

Chao, W. et al., "Soft X-Ray Microscopy at a Spatial Resolution better than 15nm," Nature Publishing Group, vol. 435/30, Jun. 2005, pp. 1210-1213.

Chao, W. et al., "Zone Plate Microscopy to Sub-15 nm Spatial Resolution with XM-1 at the ALS," IPAP Conf. Series 7, Proc. 8th Int. Conf. X-ray Microscopy, pp. 4-6.

Jefimovs, K. et al., "Zone-Doubling Technique to Produce Ultra-high-Resolution X-Ray Optics," Physical Review Letters, Dec. 31, 2007, pp. 264801-264804.

Snigireva, I. et al., "Stacked Fresnel Zone Plates for High Energy X-Rays," Synchrotron Radiation Instrumentation: Ninth International Conference, American Institute of Physics, 2007, pp. 998-1001.

Vila-Comamala, J. et al., "Advanced Thin Film Technology for Ultrahigh Resolution X-Ray Microscopy," Elsevier, Ultramicroscopy 109, Jul. 7, 2009, pp. 1360-1364.

Vila-Comamala, J. et al., "Dense High Aspect Ratio Hydrogen Silsesquioxane Nanostructures by 100 ke V Electron Beam Lithography," IOP Publishing, Nanotechnology, vol. 21, Jun. 18, 2010, pp. 1-6.

Vila-Comamala, J. et al., "Ultra-high Resolution Zone-Doubled Diffractive X-Ray Optics for the Multi-keV Regime," Optics Express, vol. 19, No. 1, Jan. 3, 2011 pp. 175-184.

Chen, Sharon et al., "Absolute Efficiency Measurement of High-Performance Zone Plates", Proc. of SPIE, vol. 7448, pp. 74480D-74480D-9, Aug. 20, 2009.

Chubarova, E. et al., "Platinum Zone Plates for Hard X-Ray Applications", Microelectronic Engineering, vol. 88:10, pp. 3123-3126, Jun. 20, 2011.

Feng, Yan et al., "Nanofabrication of High Aspect Ratio 24 nm X-Ray Zone Plates for X-Ray Imaging Applications", Journal of Vacuum Science and Technology, vol. 25:6, pp. 2004-2007, Dec. 6, 2007.

International Search Report and Written Opinion of the International Searching Authority mailed Jan. 20, 2014, from counterpart International Application No. PCT/US2013/067721.

Shastri S.D. et al., "Microfocusing of 50 keV Undulator Radiation with Two Stacked Zone Plates", Optics Communications, North-Holland Publishing Co., vol. 197:1-3, pp. 9-14, Sep. 15, 2001.

International Preliminary Report on Patentability, mailed on May 14, 2015, from counterpart International Application No. PCT/US2013/067721, filed on Oct. 31, 2013.

* cited by examiner

STACKED ZONE PLATES FOR PITCH FREQUENCY MULTIPLICATION

RELATED APPLICATIONS

This application claim the benefit under 35 USC 119(e) of U.S. Provisional Application No. 61/721,659, filed on Nov. 2, 2012, which is incorporated herein by reference in its entirety.

BACKGROUND OF THE INVENTION

Lens-based high-resolution x-ray microscopy largely resulted from research work at synchrotron radiation facilities in Germany and the United States starting in the 1980s. While projection-type x-ray imaging systems with up to micrometer resolution have been widely used since the discovery of x-ray radiation, systems using x-ray lenses with sub-100 nanometer (nm) resolution began to enter the market only this century. These high-resolution microscopes are configured similarly to visible-light microscopes with an optical train typically including an x-ray source, condenser, objective lens, and detector.

Because x rays do not refract significantly in most materials, nearly all such high-resolution x-ray microscopes use diffractive objective lenses, called Fresnel zone plates, as objective lenses. Fresnel zone plates act as ideal thin lenses for monochromatic x-rays. They are essentially circular diffraction gratings, with the grating spacing decreasing with increasing distance from the center in order to progressively increase the diffraction angle and thus produce the focusing effect. By year 2009, x-ray microscopes using synchrotron x-ray sources have achieved 30 nm resolution, and commercial systems using laboratory x-ray sources have achieved 50 nm resolution.

Compared with the widely used visible light and electron microscopy techniques, x-ray microscopy combines properties that make it favorable for a large number of applications: (1) high energy x rays have a very large penetration length to image internal structures of thick samples without preprocessing; (2) the absorption and fluorescence emission depends strongly on the elemental composition of the sample, allowing high-sensitivity material analysis; and (3) x-ray imaging causes minimal structural damage to samples without inducing a charging effect upon the samples.

One key component of an x-ray microscope is the objective zone plate lens that focuses the x-rays and magnifies the transmitted image of the sample onto the x-ray detector. The diffraction-limited resolution of the zone plate lens is $\delta=1.22\,\Delta r_n$, the focal length is $f=2r_n/(\lambda\Delta r_n)$, and the numerical aperture is $NA=\lambda(2\Delta r_n)$, where $r_n$ is the radius of the outermost zone, $\Delta r_n$ is the width of the outermost zone, and $\lambda$ is the wavelength. Zone plates with zones intended primarily to block x-ray radiation are called amplitude zone plates. They can provide up to 10% focusing efficiency. Zone plates with zones intended to produce an ideally $\pi$ phase shift are called phase zone plates. They can provide up to 40% efficiency. In practice, a zone plate will both absorb and phase shift the x-ray beam impinging on it, and will behave as a combination of an amplitude and a phase zone plate. For high-energy x-rays, the phase shift dominates and zone plates behave closer to phase zone plates. Even higher theoretical efficiency can be achieved when the zones approximate the profile of a Fresnel lens. This type of "blazed" zone plate can achieve 100% theoretical focusing efficiency, but is difficult to realize or approximate in practice.

The efficiency of a zone plate is limited in practice by the achievable thickness of the zones of the zone plates. An amplitude zone plate reaches its maximum efficiency when each zone completely absorbs the x-ray beam; and a phase zone plate reaches its maximum efficiency when each zone shifts the phase of the x-ray beam by $\pi$, with no absorption. For example, with higher x-ray energy, the zone thickness must be increased to maintain absorption or phase shift.

With higher energy x-ray radiation, thicker zone plates are required to achieve optimal efficiency. For example, a gold zone plate having a thickness of 1650 nm reaches a maximum efficiency of 31% at just below x-ray energy of 9.5 keV. At this same energy, a 350 nm thick zone plate has an efficiency below 3%, which illustrates that the efficiency of zone plates at higher x-ray energy values is limited by the thickness of the zone plates. Therefore, the main challenge when making high resolution and high efficiency zone plate lenses involves making zone plate structures with high zone plate thickness versus zone width aspect ratios, especially with increasing x-ray energy. For example, zone plates with a 50 nm outer zone width requires an aspect ratio of 33 to obtain optimum efficiency for an x-ray energy of 9.5 keV. Such a high aspect ratio often poses significant difficulty for fabricating a single optic element and has been a limiting factor in achieving high resolution imaging using higher energy x-rays.

The criticality in fabricating thicker zone plates is in the fabrication and the mechanical stabilization of the outer zones. It is here that the aspect ratios become extreme. This is because the outer zones are the narrowest zones, and yet also have to be the same height as the other, inner, wider zones. Fabricating these zones challenges existing fabrication processes such as plating technology due to the narrowness of the zones. In addition, because of their narrowness, the high aspect ratio zones are more susceptible to breakage by mechanical stress or other stresses due to charging effects.

Some have proposed to fabricate effectively thick zone plates by aligning and stacking separate zone plates to create a compound optic. One specific example relies on the formation of a zone plate doublet by fabricating two zone plates on either side of a common substrate. This approach is problematic, however, because it necessitates thin substrates and front side and backside alignment and fabrication. Moreover, the first fabricated zone plate must survive the fabrication process for the second zone plate. Another approach relies on the fabrication of a series of zone plates successively, stacked one on top of the other. In this approach, however, alignment tolerances increase with each stacked plate. As a result, the stacked approach requires effective planarization prior to forming the next zone plate of the stack, along with techniques for stabilizing the zones sufficiently to survive multiple planarization processes.

Nevertheless, compound x-ray optical elements have been developed. U.S. Pat. No. 6,917,472 B1 describes an Achromatic Fresnel Optic (AFO). This is typically a two element compound optic that is comprised of a diffractive Fresnel zone plate and a one or more refractive Fresnel lenses. Generally, AFO's have been proposed for imaging short wavelength radiation including extreme ultraviolet (EUV) and x-ray radiation. The diffractive element is the primary focusing element, and the refractive element typically provides no or very little net focusing effect. It serves to correct the chromatic aberration of the zone plate.

SUMMARY OF THE INVENTION

This invention pertains to compound x-ray lenses and the method of fabricating these lenses with an emphasis on the zone plate lenses. These compound lenses include multiple, complementary zone plates to achieve a pitch frequency increase for the resulting compound zone plate, which leads to higher imaging resolution and numerical aperture. Also, an efficiency increase of the resulting combined zone plates can be achieved due to an increase in the aspect ratio of the zones that can be manufactured.

The invention also pertains to the use of Atomic Layer Deposition (ALD) technology and adapting this technology, or similar conformal thin film coating technology, to fabricate zone plates.

In general, according to one aspect, the invention features a compound zone plate comprising a first zone plate having an initial pitch frequency, and a second zone plate having complementary zone placement. The zone plates are mechanically stacked together to form a compound zone plate having a pitch frequency that is greater than the initial pitch frequency.

In one embodiment, the compound zone plate has a mark-to-space ratio of 1:1 in the outermost zones. The individual zone plates have a mark-to-space ratio of 1:2n+1, wherein n is 1 or higher.

In one embodiment, the first and second zone plates are complementary Atomic Layer Deposition (ALD) zone plates. In general, the zones of the first and second zone plates are layers deposited on sidewalls of a patterned resist template.

In other aspects, the zones are of the zone plates are Gold, Platinum, Tungsten, or Iridium.

Some embodiments include a third zone plate mechanically stacked with the first and second zone plates and some of these embodiments further include a fourth zone plate mechanically stacked with the first, second, and third zone plates.

In general, according to another aspect, the invention features method for fabricating a compound zone plate comprising fabricating a first zone plate using atomic layer deposition to deposit zones on sidewalls of a first patterned resist template and fabricating a second zone plate using atomic layer deposition to deposit zones on sidewalls of a second patterned resist template that provides complementary zone placement relative to the zones of the first zone plate, and stacking the first zone plate on the second zone plate to form a compound zone plate.

In general, according to another aspect, the invention features a method for fabricating a compound zone plate comprising fabricating a first zone plate having an initial pitch frequency, fabricating a second zone plate with a complementary zone placement relative to the zones of the first zone plate, and stacking the first zone plate on the second zone plate to form a compound zone plate having a pitch frequency that is greater than the initial pitch frequency.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same or similar parts throughout the different views. The drawings are not necessarily to scale; emphasis has instead been placed upon illustrating the principles of the invention. Of the drawings.

DETAILED DESCRIPTION OF THE PREFERRED EMBODIMENTS

The present invention deals with the stacking of sets of zone plates for pitch frequency multiplication. In particular, use of multiple zone plate stacking enables the pitch frequency to increase for the resulting compound zone plate. This is based on the mark-to-space ratio, which is the ratio of the duration of a positive-amplitude part of a square wave to that of a negative-amplitude part along with the shifting of the relative phase of the zones between the plates to be complementary.

For example, a pitch frequency can be doubled in a completed compound zone plate that has a mark-to-space ratio of 1:1. This compound zone plate is formed with two stacked zone plates each having a mark-to-space ratio of 1:2n+1, where n=1. In turn, a frequency tripled compound zone plate is fabricated from three stacked zone plates that each have a mark-to-space ration of 1:2n+1, where n=2, and a frequency quadrupled compound zone plate is fabricated from four stacked zone plates that each has a mark-to-space ratio of 1:2n+1, where n=3.

The present invention also deals with optimizing the layout of the zones and mark-to-space ratio when fabricating zone plates using the ALD or other conformal thin film coating process.

Figure 1A:
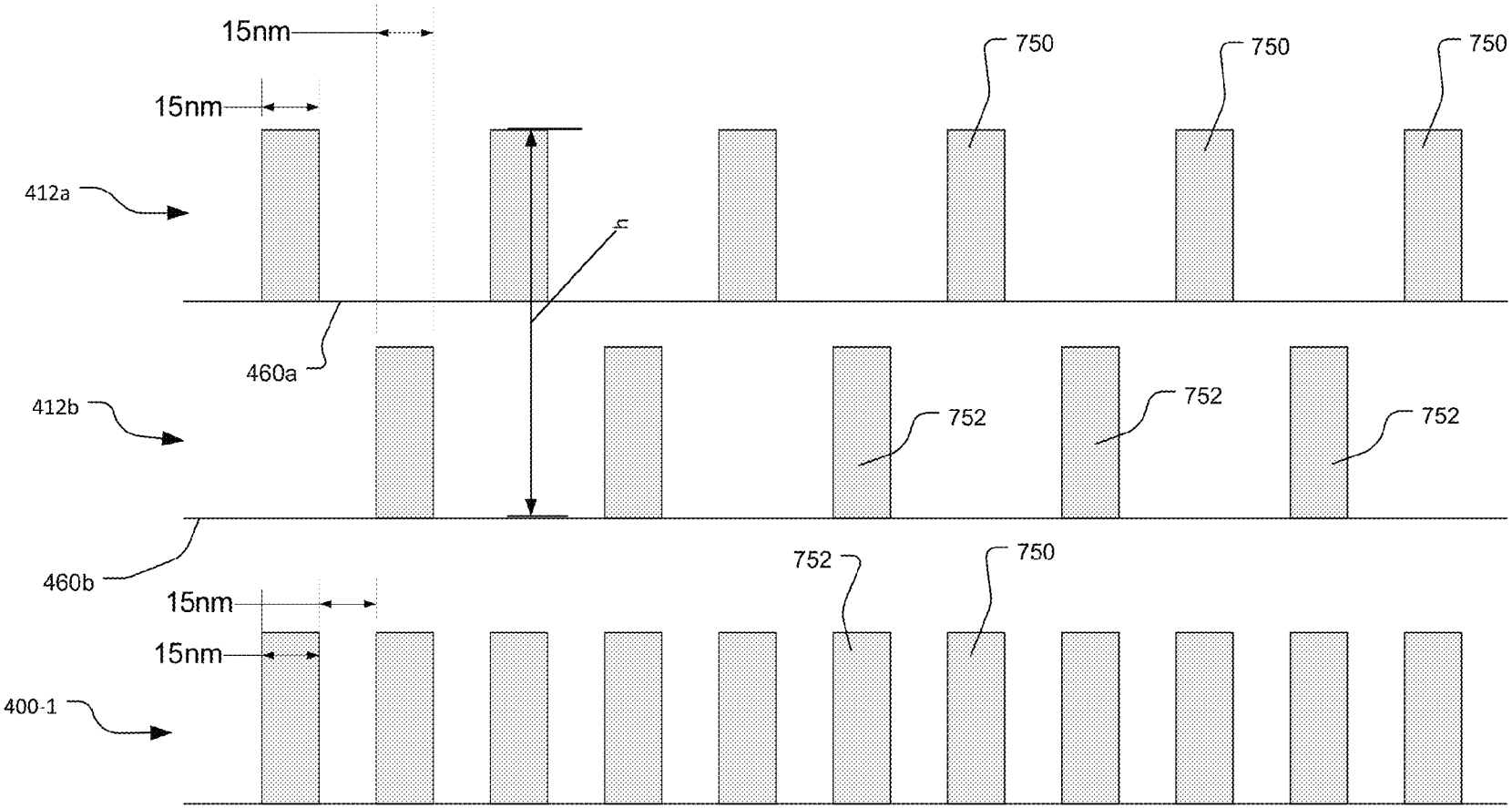
FIG. 1A is a partial cross-sectional view of two zone plates and the effective pitch of a resulting compound zone plate illustrating the stacking of two zone plates for pitch frequency multiplication (two-fold) according to an embodiment of the present invention.

FIG. 1A illustrates the relationship between the zones of two stacked zone plates to form a compound zone plate lens 400-1 that has a two-fold increase in pitch frequency relative to zone plates 412*a*, 412*b*. Shown here are only some of the outermost zones, which have approximately constant pitch and width.

In this example, the compound zone plate 400-1 with a complete profile is fabricated by stacking two zone plates 412*a*, 412*b* with a complementary, e.g., slightly offset zone placement. The zone plates 412*a*, 412*b* are supported on respective substrates or membranes 460*a*, 460*b*. The zone plates 412*a*, 412*b* have equal width zones 750, 752, which are 15 nm in the illustrated example. They further have equal spaces between zones, which are three times the zone widths, or 45 nanometers. This results in a pitch that is four times the zone width, or 60 nm in the example. Thus, these zones 750, 752 are separated from each other (plate to plate) at a distance equal to their width, or 15 nm in the illustrated example.

The two zone plates 412*a*, 412*b* are set such that each has every other zone 750, 752 (mark-to-space ratio 1:3), so that when combined they form a compound zone plate 400-1 with a mark-to-space ratio 1:1. The result is a doubled or two-fold increase in pitch frequency. When the zone plates 412*a*, 412*b* are stacked together with the distance (h) between zone plates being less than the depth of focus, they function as a single element with a line profile of equally sized zones 750, 752 spaced from one another by an amount equal to each zone width.

Figure 1B:
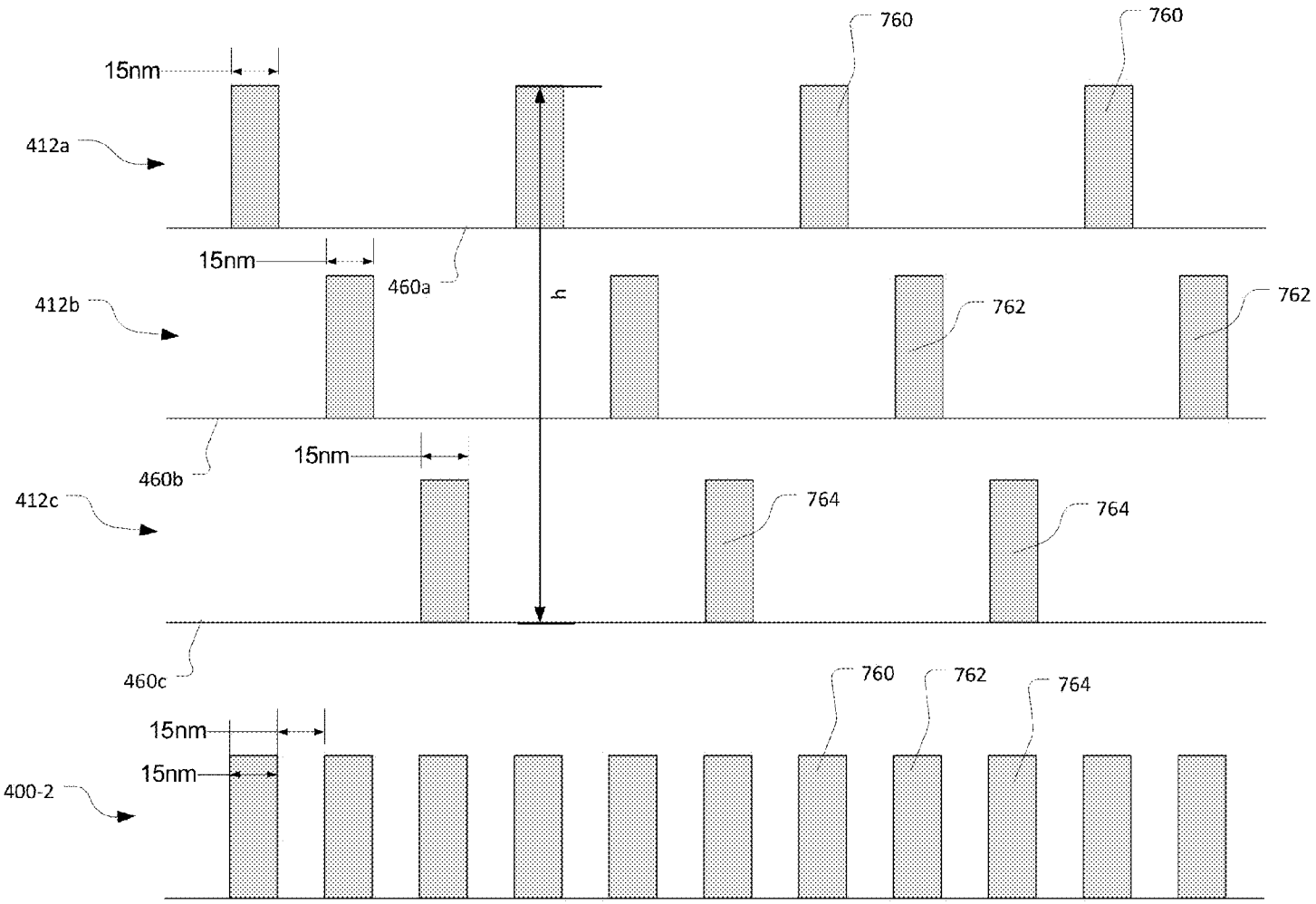
FIG. 1B is a partial cross-sectional view of three zone plates and the effective pitch of a resulting compound zone plate illustrating the stacking of three zone plates for pitch frequency multiplication (three-fold) according to an embodiment of the present invention.
Figure 1C:
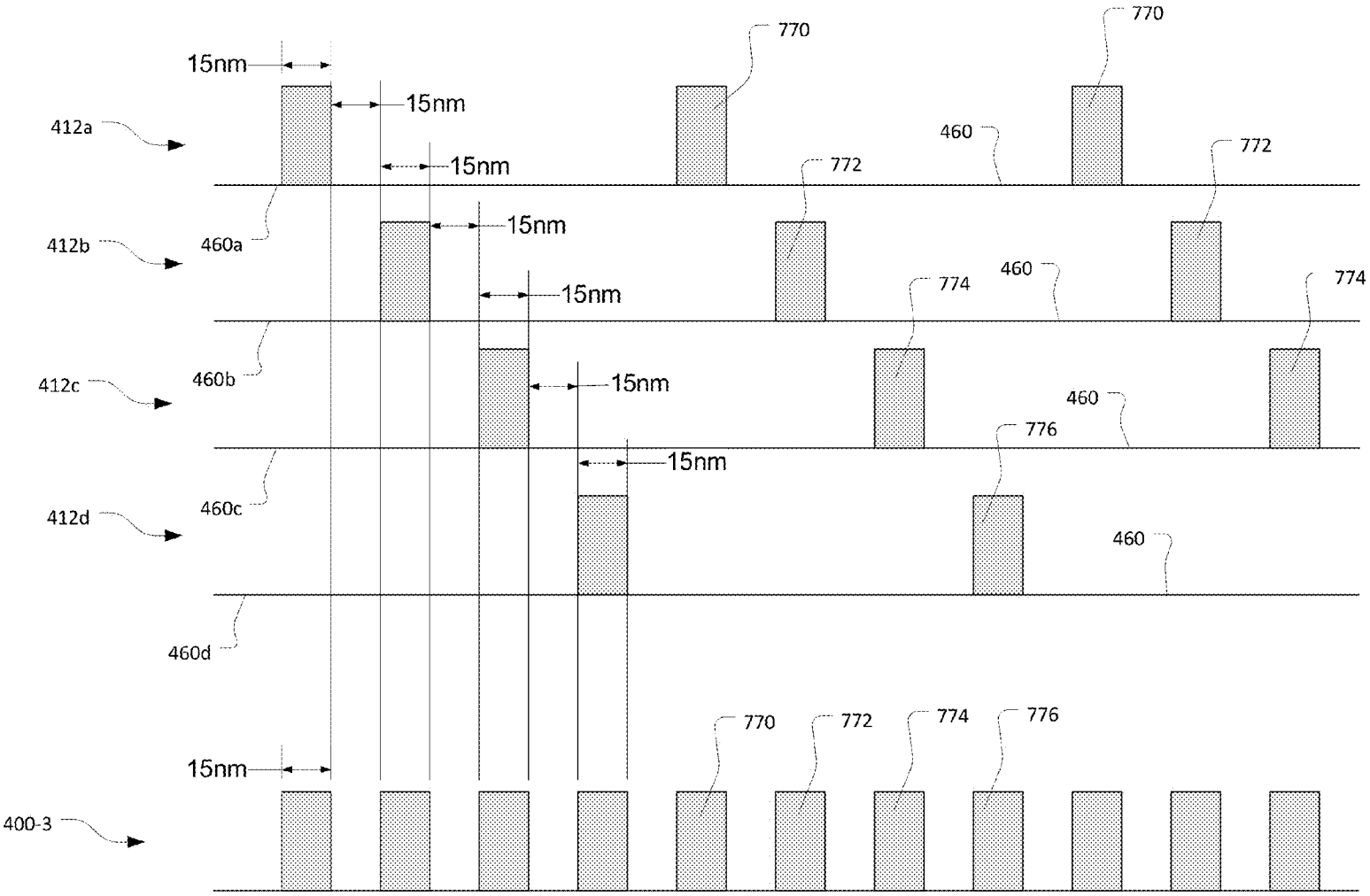
FIG. 1C is a partial cross-sectional view of four zone plates and the effective pitch of a resulting compound zone plate illustrating the stacking of four zone plates for pitch frequency multiplication (four-fold) according to an embodiment of the present invention.

FIGS. 1B-1C show examples of stacking three zone plates 412*a*, 412*b*, 412*c* to form a compound zone plate 400-2 and the stacking of four zone plates 412*a*, 412*b*, 412*c*, 412*d*, to form a compound zone plate 400-3. The pitch frequency multiplication through stacking can be generalized to the case of the number (m) of zone plates, yielding an (m)-fold increase in pitch frequency based on "m" zone plates to be stacked.

The exact stacking method depends on the number of zone plates that are intended to be combined. Similar to FIG. 1A, FIGS. 1B-1C illustrate zones positioned in each zone plate to form compound zone plates 400-2, 400-3 that have equal sized zones that are arranged together in a line profile.

For example, in FIG. 1B the stacking of three zone plates 412*a*, 412*b*, 412*c*, with complementary zone placement results in an equivalent zone plate 400-3 having a three-fold increase in pitch frequency.

The first zone plate 412*a* has zones 760 formed on membrane or substrate 460*a* that have a width of about 15 nm and a spacing between zones that is 5-fold larger.

The second zone plate 412*b* has zones 762 formed on membrane or substrate 460*b* that are equal in width to the first zone plate zones 760 but offset by a distance that is twice the zone width such that there is a space equal to the zone width between the zones 760 of the first zone plate 412*a* and the zones 762 of the second zone plate 412*b*.

The third zone plate 412*c* has zones 764 formed on membrane or substrate 460*c* that are equal in width to the zones of the other zone plates 412*a*, 412*b*. Further, the third zone plate 412*c* has zones 764 that are offset by a distance that is twice the zone width relative to the second zone plate 412*b* such that there is a space equal to the zone width between the zones 762 of the second zone plate 412*b* and the zones 764 of the third zone plate 412*c*.

When these three zone plates 412*a*, 412*b*, 412*c* are combined, they form a compound zone plate 400-2. The zones 760, 762, 764 are equally spaced from each other to form effectively a line of zones that will function as a single optical element so long as the overall distance (h) is less than the depth of focus.

FIG. 1C shows the stacking of four zone plates 412*a*, 412*b*, 412*c*, 412*d* with complementary zone placement that are formed on respective membranes or substrates 460*a*, 460*b*, 460*c*, 460*d*. The stacking results in a compound zone plate 400-3 having a four-fold increase in pitch frequency. These zone plates 412*a*, 412*b*, 412*c*, 412*d* have zones 770, 772, 774, 776 that are each spaced an equal distance forward from the zones in the previous plate. Yet, in each zone plate 412*a*, 412*b*, 412*c*, 412*d*, the respective zones 770, 772, 774, 776 have a mark-to-space ratio of 1:7.

Figure 2:
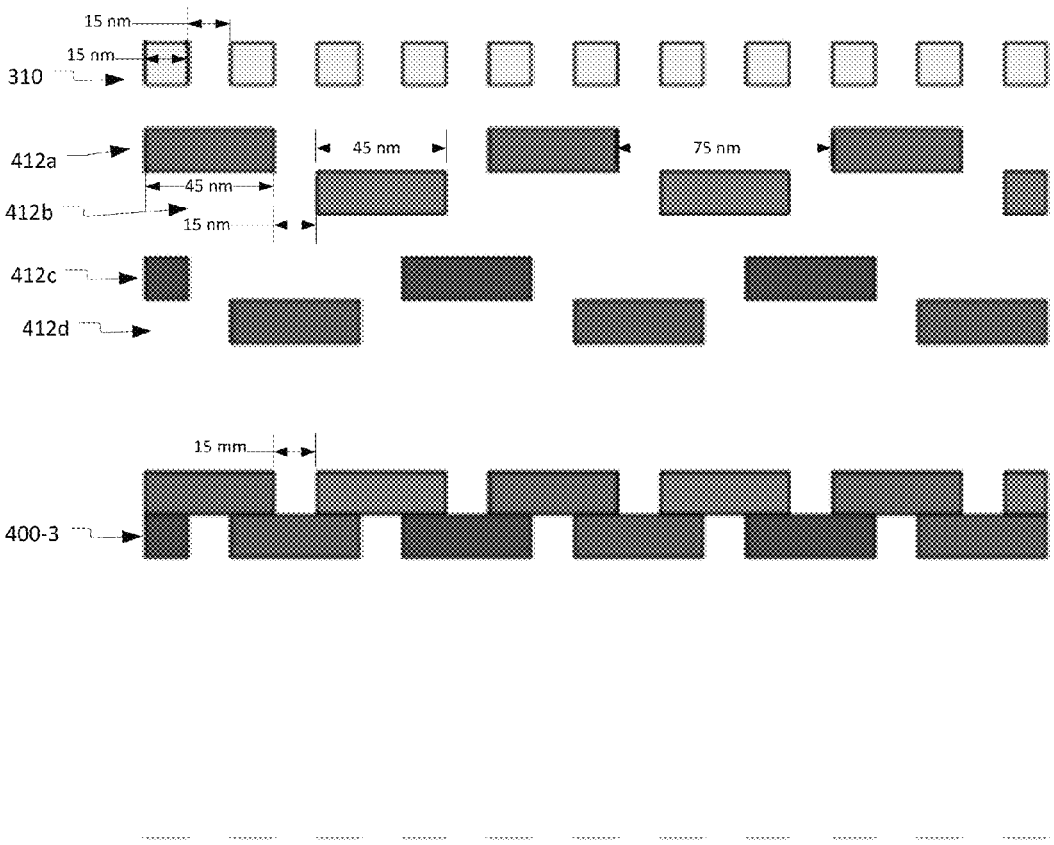
FIG. 2 illustrates another example of the stacking of four zone plates according to an embodiment of the present invention to achieve an increase in pitch frequency.

FIG. 2 illustrates still another embodiment for increasing pitch frequency. Here, a 15 nm zone width equivalent zone plate 400-3 can be achieved through a 4-stacking technique using four zone plates 412*a*, 412*b*, 412*c*, 412*d* with 45 nm wide zones and 75 nm spaces. The resulting stacked equivalent zone plate 400-3 yields an effective zone period 310. This stacking provides effectively a four-fold pitch frequency increase.

Another advantage of using this embodiment is the significantly reduced difficulty of fabricating 45 nm zone plates compared to 15 nm zone plates. The main requirement of this method is the precise manufacture of the width of the zones and the vertical side-wall profile. Additionally, given the 45 nm zone width, a larger zone thickness can be achieved, resulting in increased efficiency of the compound zone plate 400-3.

In one example, the alignment uses identical zone plates, such that the zones are directly above each other. The stacking of identical zone plates creates a zone plate with the same number of zones with twice the thickness. In an alternative more preferred example, i.e. resolution doubling mode, complementary zone plates are used, such that the zones of the top zone plate are exactly interlaced between the zones of the bottom zone plate. This gives twice as many zones as compared to stacking of identical zone plates.

In still other embodiments, the patterns of the zone plates 412*a*, 412*b*, 412*c*, and/or 412*d* are fabricated using Atomic Layer Deposition (ALD) frequency multiplication.

Figure 3:
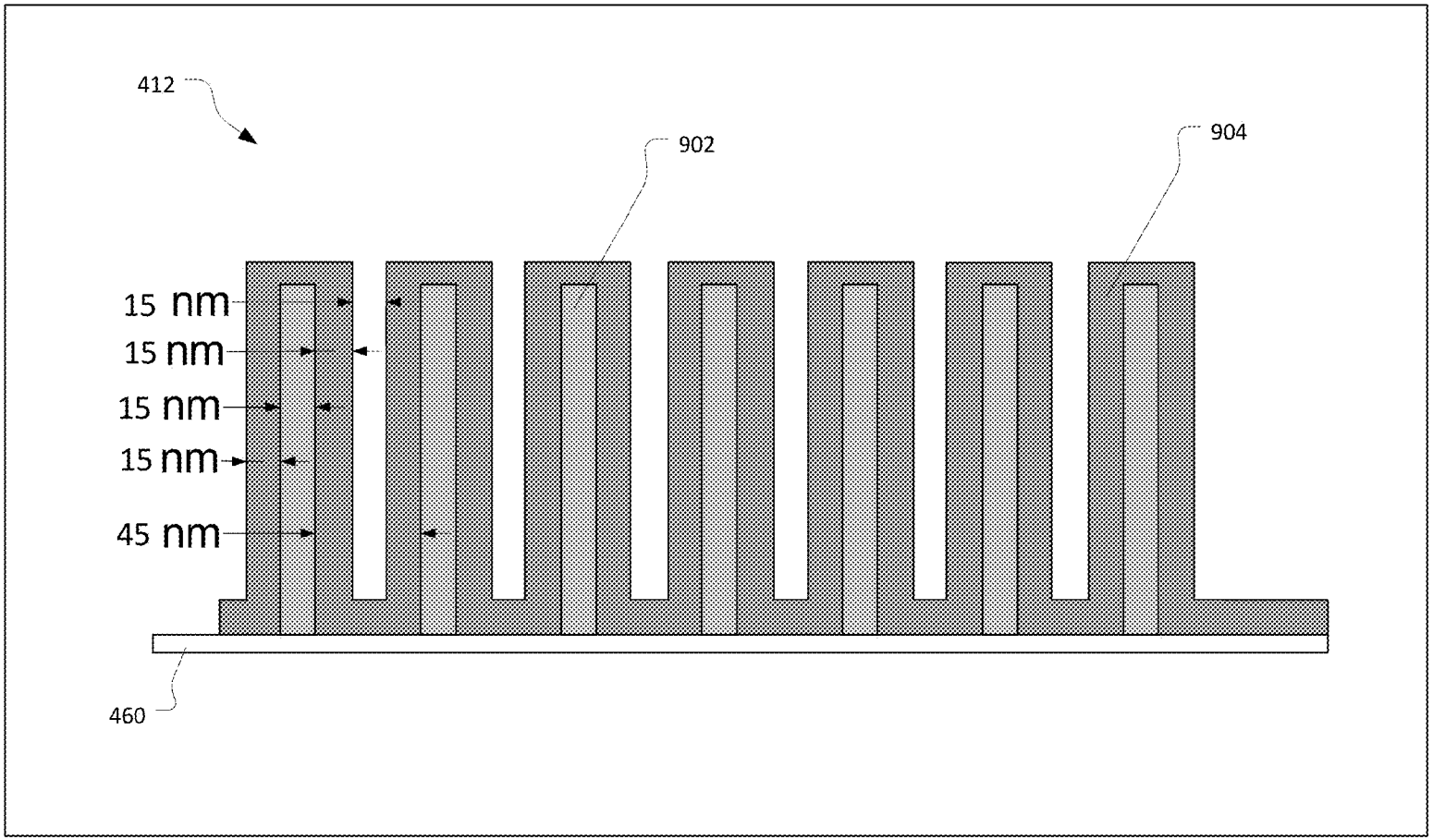
FIG. 3 is a cross-sectional view of the outer zones of an atomic layer deposition (ALD) zone plate.

FIG. 3 shows a portion of a cross-section of an atomic layer deposition (ALD) zone plate 412. In this conventional technique, the zone template 902, such as a patterned layer of hydrogen silsesquioxane resist, is coated with an ALD deposited layer 904, such as Iridium or Platinum, to form the ALD zone plate 412. This basic approach is described in "Zone-Doubling Technique to Produce Ultrahigh-Resolution X-Ray Optics," by Jefimovs, et al., in Physical Review Letters, 99, 264801, (2007).

In general, the template 902 is a low density material that interacts weakly with x-rays such that the dominant effect is produced by the ALD layer or coating 904.

ALD is a thin film deposition procedure that uses a gas phase chemical process. Typically, the ALD process uses at least two chemicals (precursors) that react with a surface in a sequential order. A thin film is deposited on the surface of a zone template from the continuous application of these precursors. More relevantly, the thin film is deposited on the vertical sidewalls of the template 902 in order to form the thick zones of the zone plate.

An ALD zone plate 412 is fabricated by applying layers onto the membrane or substrate 460. A main advantage of fabrication with ALD versus conventional methods is the aspect ratio, which is limited by the sidewall angle tolerance in conventional methods. The thickness of the ALD layer 904 is typically 1 nm, and can possibly be even thinner. Using a resist zone template 902 such as hydrogen silsesquioxane (HSQ), a straighter sidewall can be obtained and therefore, higher aspect ratios are possible.

In this example, the ALD zone plate 412 or Fresnel zone plate (FZP) is made of an HSQ resist template 902, or HSQ template, and an ALD layer or coating 904. The HSQ resist template 902 is coated by an ALD layer 904 of metal such as Iridium. The ALD layer 904 preferably has a width that matches an outermost zone width of the ALD zone plate 412, and a thickness that matches that of the HSQ resist layer 902. At the outer edge of the plate, the Iridium line density is increased at least two-fold as compared to the HSQ template 902.

In one example, the process of making the zone-doubled FZP 412 uses 100 keV electron-beam lithography for exposing template patterns onto an HSQ resist layer 902. This HSQ resist layer 902 is typically applied using a high contrast developer such as buffered sodium hydroxide solution. This is followed by supercritical drying in carbon dioxide to form the final HSQ template 902. The HSQ template 902 is coated with an ALD layer 904 of iridium. Films of metallic Iridium 904 are deposited on the HSQ resist template 902 using an ALD process with a temperature range from about 225 to about 375 degrees Celsius. The thickness of the Iridium ALD layer 904 on the HSQ resist template 902 is linearly dependent on the number of ALD cycles.

In the illustrated example, the HSQ resist template 902 has a 15 nm width, and the width of the iridium ALD layer 904 is substantially the same, i.e., 15 nm. The space between the iridium ALD layer 904 is also 15 nm with a pitch of 30 nm.

Using ALD to fabricate zone plates additionally provides a zone frequency doubling technique upon the plates. This is because the underlying structure before ALD has a period of half the frequency of the resulting ALD zone plate 412. This allows fabrication of ultra-high resolution zone plates with large heights (e.g. 15 nm width and 250 nm height).

According to an aspect of the invention, the alignment of complementary ALD zone plates allows yet another doubling or more of the zone plate pitch frequency while keeping the height of the resulting zones the same as a single ALD zone plate. For example, when the alignment causes the zone width to be reduced by a factor of 2, the resolution and numerical aperture are correspondingly increased by a factor of 2. This alignment method also enables fabrication of zone plates with zone widths down to 5 nm.

The range of zone widths that are of interest is about 5 nm to about 35 nm according to current embodiments.

For standard ALD fabrication, the zone width is the same width as the smallest feature in the underlying mold structure limiting the attainable aspect ratio to ~25:1 (for example, 15 nm width and 375 nm height). However, in one embodiment, the underlying mold structure or resist layer 902 has a minimum width 3 times larger than the zone width of the ALD coating 904. Hence, the attainable aspect ratio is expected to be increased by 3 times up to 75:1 by using the principles of the present invention.

Alternatives to iridium for the ALD deposited layer 904 include gold, platinum, and tungsten. Platinum and tungsten are preferred over gold, since they have a higher density than gold.

Alternatives to HSQ for the template 902 include silicon, silicon carbide, silicon nitride, and diamond.

In still other embodiments, other conformal thin film coating techniques are used instead of the traditional ALD process.

The effective zone thickness of the ALD layer 904 can vary and is determined by the height of the resist template 902. At 8 keV, the effective zone thickness for iridium would be about 1.34 micrometers (optimum). In other examples, the effective zone thicknesses are in the range of about 0.1 micrometers to about 3 micrometers depending on the energy targeted in terms of practical interest. In one example, gold is used, which has an optimum thickness of about 1.53 micrometers at 8 keV and can be approximated by aligning two identical 700 nm thick zone plates but with a shift in the zone placement between the plates.

In FIG. 3, the regular ALD zone plate 412 has a mark (15 nm) to space (45 nm) ratio of 1:3 of the resist template 902. The 20 nm electron-beam lithography written zones of the template 902 are coated with a 20 nm layer through ALD, resulting in a zone plate 412 with mark-to-space ratio of 1:1 and 20 nm zone widths. The limiting feature in the fabrication process is the 20 nm wide pillars of the template 902.

Figure 4:
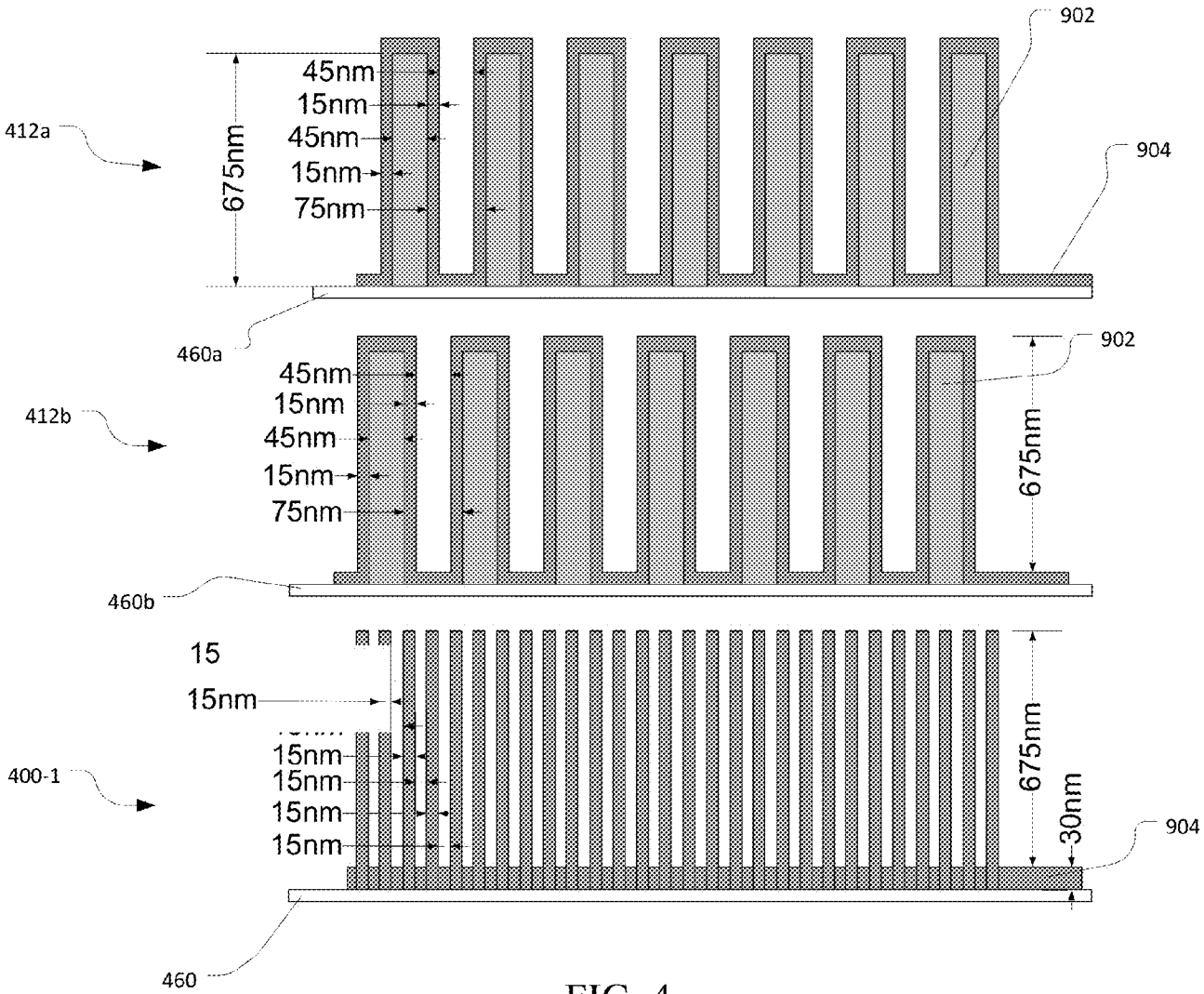
FIG. 4 illustrates the stacking of two ALD zone plates for pitch frequency multiplication according to an embodiment of the present invention.

FIG. 4 illustrates the process of stacking two complementary ALD zone plates 412*a*, 412*a* together using a stacking process according to the principles of the invention. The underlying HSQ structures (before atomic layer deposition) have a mark (45 nm) to space (75 nm) ratio of 3:5, which makes these structures much easier to fabricate than for the same equivalent zone thickness in a regular ALD zone plate as illustrated in FIG. 3 (15 nm mark to 45 nm space–ratio of 1:3).

A lower-density HSQ resist 902 is coated with an ALD layer 904 of metal on a layer-by-layer basis to yield a desired coating thickness of 15 nm. This thickness corresponds to the zone width of the compound zone plate 400-1. This allows for exact control of the total layer thickness, down to about one single atomic layer. The limiting feature in the fabrication process is the 45 nm wide pillars 902.

Aligning the two zone plates 412*a*, 412*b* makes an equivalent compound zone plate 400-1 of 15 nm width zones. The combination of using these ALD zone plates 412*a*, 412*b* and stacking yields an equivalent 15 nm zone width zone plate by fabricating an underlying mold structure 902 with 45 nm width. The focusing efficiency is also improved with the stacking of ALD plates because taller zones can be fabricated in the single zone plates 412*a*, 412*b* to achieve optimum efficiency.

As illustrated in FIG. 4, the width of the underlying mold structure (pillars) is 45 nm, which results in maximum achievable height for these structures of 15 times the width or 675 nm (assuming a limit of the 15:1 for the aspect ratio of the process). In contrast, a standard 15 nm ALD zone plate, which requires an underlying mold structure width of 15 nm at 15:1 aspect ratio, has a height or thickness of only 225 nm. As a result, the standard 15 nm ALD zone plate has severely decreased focusing efficiency compared with the compound zone plate constructed according to the principles of the present invention.

Figure 5:
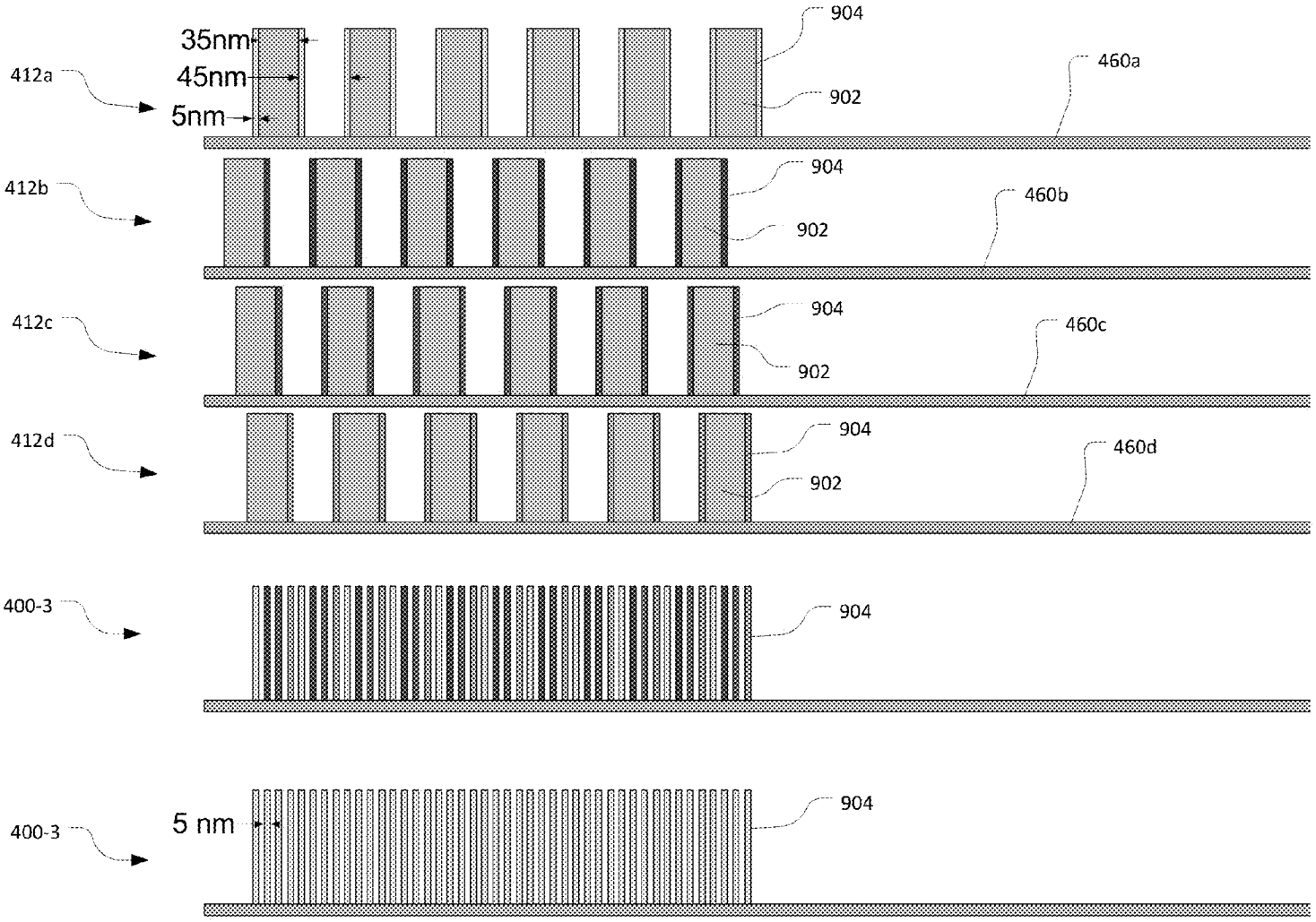
FIG. 5 illustrates the stacking of four ALD zone plates for pitch frequency multiplication according to an embodiment of the present invention.

FIG. 5 illustrates the realization of an equivalent 5 nm zone width zone compound plate 400-3 through stacking of four ALD zone plates 412*a*, 412*b*, 412*c*, 412*d*.

Each zone plate 412*a*, 412*b*, 412*c*, 412*d* has 35 nm mold widths for the HSQ template 902, 45 nm spaces of the electron-beam lithography resist, and a 5 nm coating of the ALD layer 904. This example demonstrates that the average of 40 nm zones at 20:1 aspect ratio can be combined to produce 5 nm zones at 160:1 aspect ratio. The actual limit is the side wall straightness, which for 5 nm zone plates needs to be about ⅓ of the outer most zone or 5 nm/3=1.7 nm.

Figure 6:
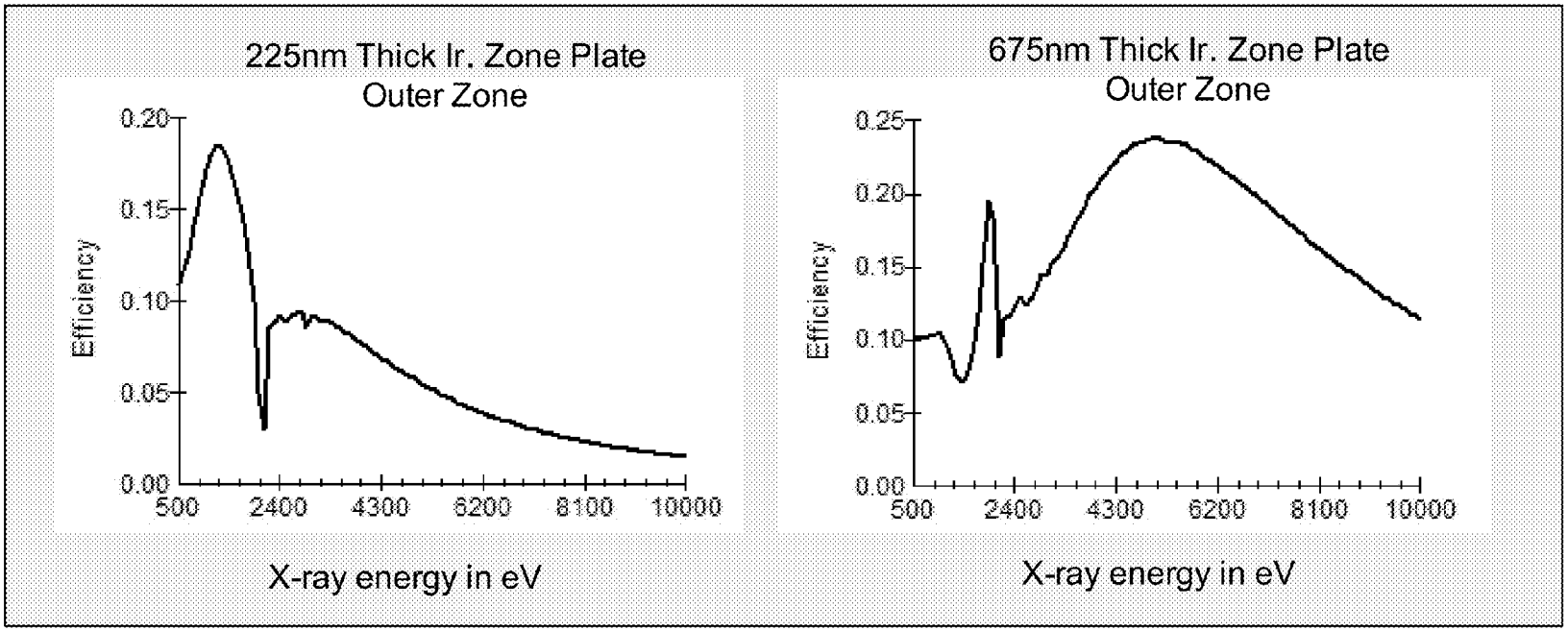
FIG. 6 is a graph of the efficiency of the outer zone of an Iridium ALD zone plate, for outer zones of 225 nm and 675 nm thicknesses.

FIG. 6 displays a graph of the efficiency for ALD zone plate 412 outer zones at 225 nm and 675 nm thicknesses. For example, at 8 keV x-ray energy, the efficiency for 675 nm is 16.6% and 2.4% for 225 nm.

Figure 7A:
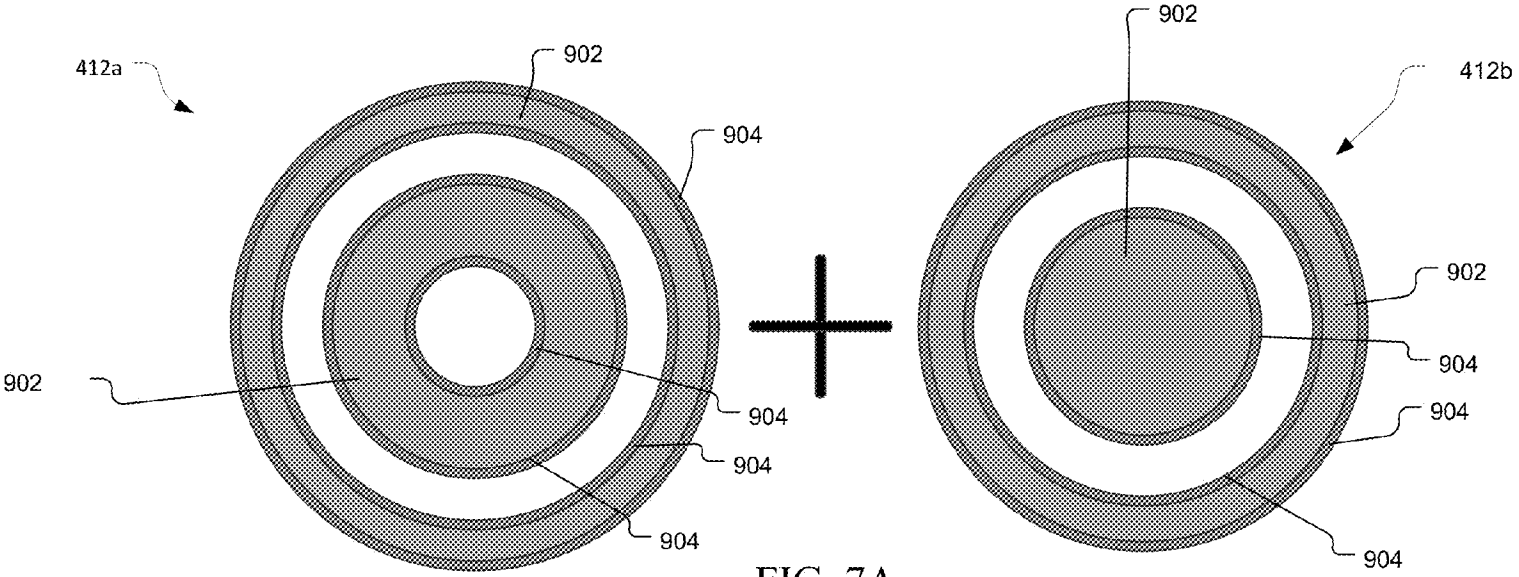
FIG. 7A is a top view of two zone plates that are being combined for pitch frequency multiplication according to an embodiment of the present invention.
Figure 7B:
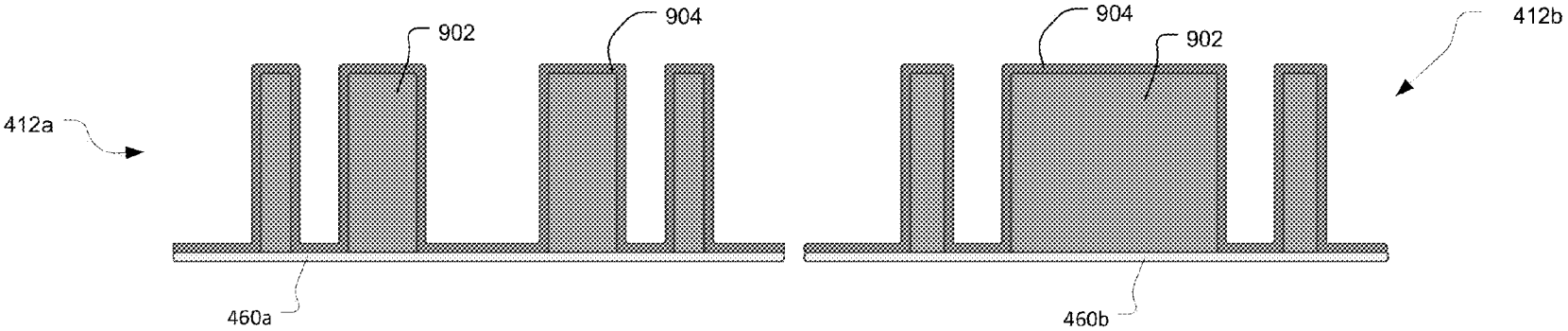
FIG. 7B is a side cross-sectional view of the two zone plates from FIG. 7A.

FIGS. 7A-7B schematically illustrate two zone plates 412*a*, 412*b* that are being combined to form a resulting compound zone plate 400-2 illustrating the above-described technique for using the ALD or other conformal coating technique. The zone patterns are simplified to better illustrate how the complementary plates 412*a*, 412*b* yield the compound plate (400-1, FIG. 8) with the desired pattern. As described above, the first zone plate 412*a* and second zone plate 412*b* each include the patterned resist 902 arranged on the membrane 460. The pattern of this resist is complementary between the plates 412*a*, 412*b*. The ALD layer 904 is then deposited on this resist 902. The combination of the circular zones formed by the ALD layer 904 forms a profile for each zone plate 412*a*.

Figure 8:
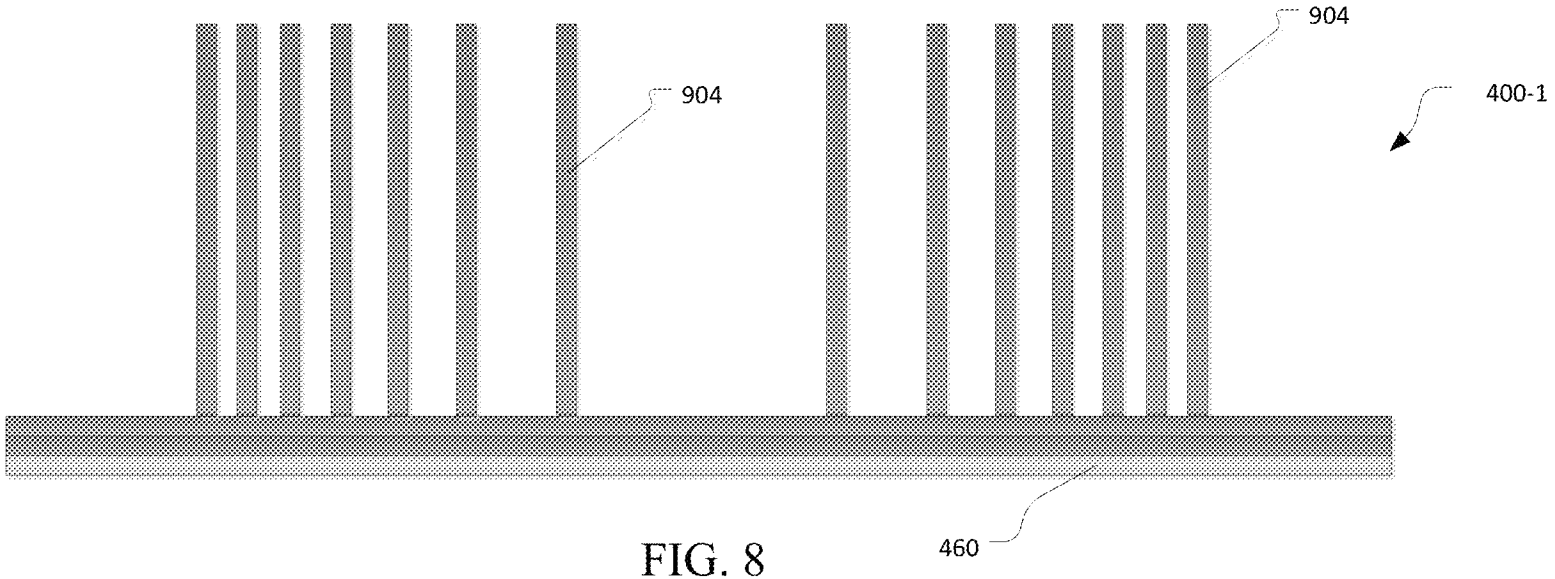
FIG. 8 shows the equivalent compound zone plate that is formed from the vertical sections of the deposited ALD layer from the zone plates from FIG. 7A/7B respectively showing the pitch frequency multiplication.

FIG. 8 shows the equivalent compound zone plate 400-1. The vertical sections of the ALD layer 904 form the pattern of the zone plate lens 400-1.

Figure 9:
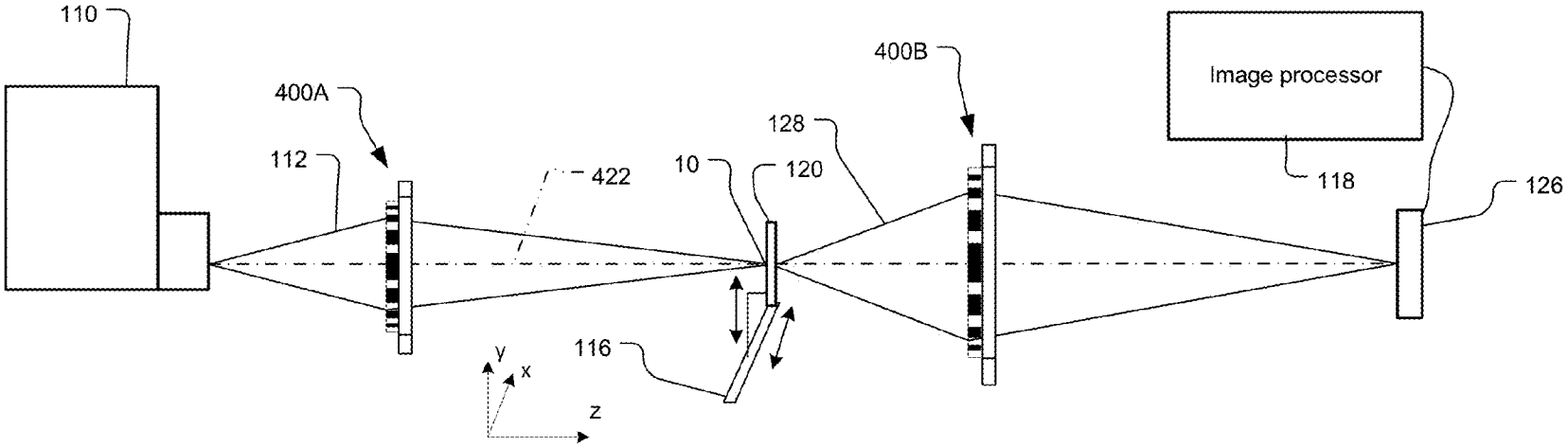
FIG. 9 is a schematic side view of an x-ray imaging system including the stacked zone plates according to an embodiment of the present invention.

FIG. 9 shows an x-ray imaging system that has been constructed according to the principles of the present invention.

The system has an x-ray source 110 that generates an x-ray beam 112 along the optical axis 122. In one embodiment, the source is a beamline of a synchrotron x-ray generation facility. In other embodiments, lower power sources are used, such as laboratory sources. Such sources often generate x-rays by bombarding a solid target anode with energetic electrons. Specific examples include microfocus x-ray sources and rotating anode sources.

The x-ray beam 112 is preferably a hard x-ray beam. In one embodiment, its energy is about 8 keV. Generally, the beam's energy is between about 2 keV and 25 keV. These higher energies ensure sufficient penetration through any intervening coating, e.g. fluid layer, on the sample 10.

A condenser 400A collects and focuses the x-ray beam 112 from the source 110. For the full field imaging setup, a suitable illumination of the sample 10 is required. This is most conveniently achieved by the use of the compound zone plate 400 as described above. Alternatively a capillary or similar optic could be used.

A sample holder 120 is used to hold the sample 10 in the x-ray beam 112. The stage 116 scans the sample holder 120 in both the x and y axis directions, i.e., in a plane that is perpendicular to the axis 422 of the x-ray beam 112. In other examples, the stage 116 further rotates the sample 10 to obtain projections at different angles, which are often used for tomographic reconstruction in an image processor 118.

An x-ray objective 400B collects transmitted x-rays 128. The x-ray beam 128 from the sample 10 is focused onto a detector system 126. In a current embodiment, the objective 400B is a compound zone plate 400 as described above.

The detector system 126 is preferably a high-resolution, high-efficiency scintillator-coupled CCD (charge coupled device) camera system for detecting x-rays from the sample 10. But other x-ray detectors, such as optical taper-based systems can also be used. In one example, a detector system as described in U.S. Pat. No. 7,057,187, which is incorporated herein by this reference in its entirety, is used. The following specific parameters ensure good performance:

Quantum detection efficiency >70% at 8 keV;

Pixel resolution element on scintillator 0.65 micrometers;

Spatially resolved (1 k×1 k elements, or greater, in a two dimensional array) CCD detector, Peltier-cooled.

According to embodiments of the invention either the condenser 400A or the x-ray objective 400B, or both, is a compound equivalent zone plate 400 as described above. In a current embodiment, however, the condenser 400A is a reflective capillary optic and only the objective is a compound zone plate 400.

Figure 10A:
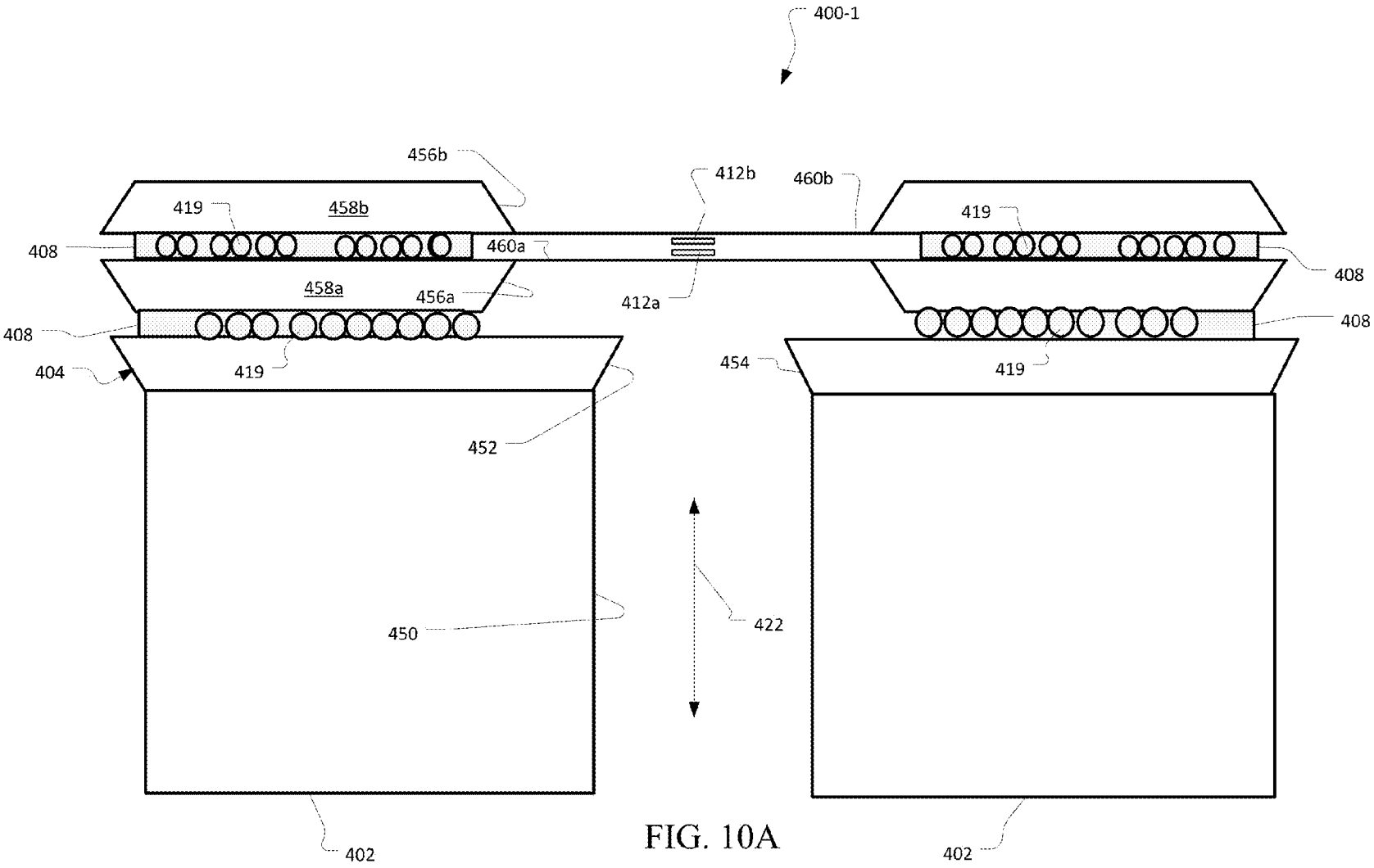
FIG. 10A is a schematic side cross-sectional view of two zone plates combined and fixed permanently to form a compound zone plate that is used to construct embodiments of the invention in one example.
Figure 10B:
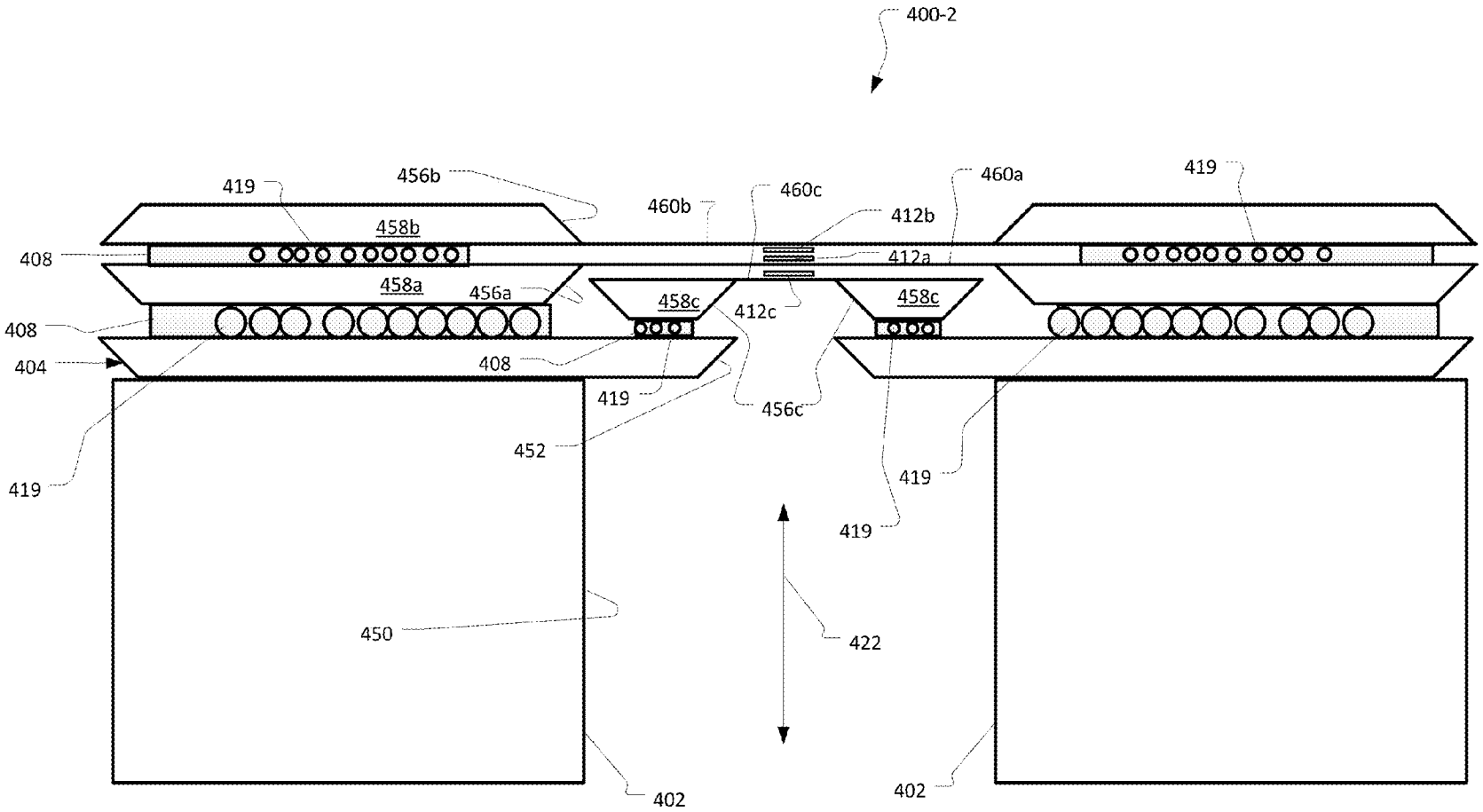
FIG. 10B is a schematic side cross-sectional view of three zone plates combined and fixed permanently to form a compound zone plate that is used to construct embodiments of the invention in one example.
Figure 10C:
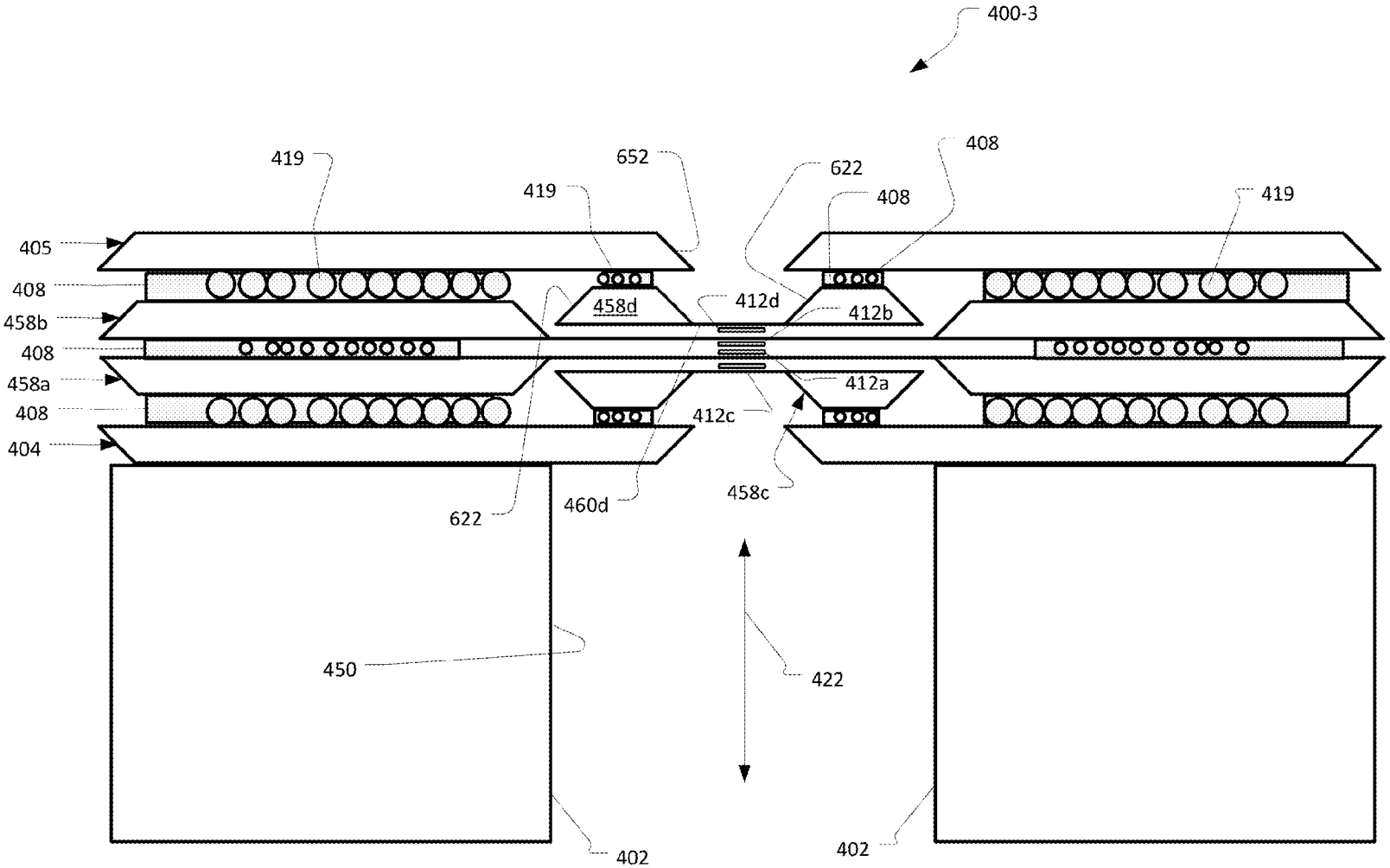
FIG. 10C is a schematic side cross-sectional view of four zone plates combined and fixed permanently to form a compound zone plate that is used to construct embodiments of the invention in one example.

FIGS. 10A-10C illustrate one approach to the construction of compound zone plates 400 of a condenser and/or objective according to a technique for implementing the present invention. The basic approach is described in U.S. Pat. No. 8,526,575 B1, filed on Aug. 12, 2010, entitled Compound X-Ray Lens Having Multiple Aligned Zone Plates, by Alan Francis Lyon, et al., which is incorporated herein by this reference in its entirety.

FIG. 10A illustrates the construction of a compound zone plate 400-1 that includes two zone plates 412*a*, 412*b* as is required to implement the embodiments shown in FIGS. 1A, 4, 7A, 7B, and 8.

The compound zone plate 400-1 is held on a holder 402. The holder 402 has an annular shape with a center optical port 450. In the typical implementation, this center optical port 450 has a circular shape when observed looking along the direction of the optical axis 422.

A bottom base frame 404 is secured on to the holder 402. The bottom base frame 404 similarly has a center optical port 452 that is aligned over the optical port 450 of the holder 402.

A first large frame 458*a* is secured to the top surface of the bottom base frame 404. The large frame 458*a* has a center optical port 456*a* that is aligned over the optical port 452 of the bottom base frame 404.

The first large frame carries a membrane 460*a* that extends over its optical port 456*a*. The membrane 460*a* is constructed from silicon nitride in a current example. In other embodiments, the membrane 460*a* is constructed from silicon carbide, silicon, silicon oxide, or diamond (carbon). Its thickness is typically between 0.05 to 2 micrometers. It is currently about 0.1 to 0.3 micrometers thick, depending on the x-ray energy used. The first zone plate 412*a* is formed on the membrane 460*a* and centered along the optical axis 422.

The first large frame 458*a* is secured to the top surface of the base frame 404 via an adhesive layer 408. Spherical microbeads 419 mixed in the adhesive layer 408 provide a controlled distance between the bottom surface of the first large frame 458*a* and the top surface of base frame 404. The beads 419 enable spacing of the base frame 404 relative to the large frame zone plate 416 by applying a force during curing of the adhesive layer. In the current embodiment, the microbeads 419 are silicon oxide because of the hardness, quality of available beads, and close thermal matching to the silicon frames.

A second large frame 458*b* is installed on the first large frame 458*a*. It similarly carries a membrane 460*b* that extends over its optical port 456*b*. The second zone plate 412*b* is formed on the membrane 460*b* and centered along the optical axis 422.

The orientation of the second large frame 458*b* is inverted such that the second zone plate 412*b* formed on the membrane 460*b* of the second large frame 458*b* is directly opposite the first zone plate 412*a* of the first large frame 458*a*.

The second large frame 458*b* is secured to the first large frame 458*a* via adhesive layer 408. Spherical microbeads 419 in layer 408 are used to define a standoff distance between the top surface of the first large frame 458*a* and the bottom surface of the second large frame 458*b*.

The two zone plates 412*a*, 412*b* form the compound zone plate 400-1.

FIG. 10B illustrates the construction of a compound zone plate 400-2 that includes three zone plates 412*a*, 412*b*, 412*c* as is required to implement the embodiment shown in FIG. 1B.

This compound zone plate 400-2 is similar to the previously described embodiment of FIG. 10A, but further has a small frame 458*c* that is secured to the bottom base frame 404. The small frame 458*c* comprises optical port 456*c* that is aligned on the optical axis 422.

The small frame 458*c* is secured to the bottom base frame 404 via adhesive layer 408. Microbeads 419 in the adhesive layer 408 separate the small frame 458*c* from the top surface of the bottom base frame 404, providing a controlled spacing between these two elements.

In this example, another membrane 460*c* is attached to the small frame 458*c* and extends over its optical port 456*c*. A third zone plate 412*c* is similarly fabricated on this membrane 460*c* of the small frame 458*c* and centered along the optical axis 422. This forms a stack of three zone plates 412*a*, 412*b*, 412*c*.

FIG. 10C illustrates the construction of a compound zone plate 400-3 that includes four zone plates 412*a*, 412*b*, 412*c*, 412*d* as is required to implement the embodiments shown in FIGS. 1C, 2, and 5.

This compound zone plate 400-3 assembly is similar to the previously described compound zone plate 400-2 assembly of FIG. 10B, but further includes a subassembly that includes a fourth zone plate 412*d*.

In more detail, the subassembly is constructed from a top base frame 405 and a second small frame 458*d*. In more detail, the top base frame 405, similar to the bottom base frame 404, includes an optical port 652.

The second small frame 458*d* is secured under the optical port 652. The second small frame 458*d* is constructed in a similar fashion to the first small frame 458*c*. It includes an optical port 622.

Another membrane 460*d* of the second small frame 458*d* extends over the optical port 622. A fourth zone plate 412*d* is fabricated on this membrane 460*d*. This forms a stack of four zone plates 412*a*, 412*b*, 412*c*, 412*d*.

The second small frame 458*d* is secured to the top base frame 405 such that their respective optical ports 622, 652 are aligned with each other. The second small frame 458*d* and the top base frame 405 are bonded together using an adhesive layer 408 and utilize microbeads 419 that provide controlled spacing between the bonded elements.

The subassembly comprising the top base frame 405 and the second small frame 458*d* is inverted and bonded onto the top surface of the second large frame 458*b*. The subassembly and the second large frame 458*b* are bonded by an adhesive layer 408 and spaced using the microbeads 419.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method for fabricating a compound zone plate comprising:

fabricating a first zone plate by depositing zones on sidewalk of a first patterned resist template using a conformal thin film coating process;

fabricating a second zone plate by depositing zones on sidewalls of a second patterned resist template using a conformal thin film coating process, wherein the second patterned resist template provides complementary zone placement relative to the zones of the first zone plate; and stacking the first zone plate on the second zone plate to form a compound zone plate and aligning the first zone plate with the second zone late so that the zones of the first zone plate are interlaced with the zones of the second zone plate, wherein the resist templates have been retained in the stacked first zone plate and second zone plate.

2. A method as claimed in claim 1, wherein the first zone plate has an initial pitch frequency and when the zone plates are mechanically stacked together to form the compound zone plate, the compound zone plate has a pitch frequency that is greater than the initial pitch frequency.

3. The method as claimed in claim 1, wherein the compound zone plate has a mark-to-space ratio of 1:1 in the outermost zones, and the first and second zone plates have a mark-to-space ratio of 1:2n+1, wherein n is an integer equal to 1 or higher.

4. The method as claimed in claim 1, wherein zones of the first and second zone plates include Gold.

5. The method as claimed in claim 1, wherein zones of the first and second zone plates include Platinum.

6. The method as claimed in claim 1, wherein zones of the first and second zone plates include Tungsten.

7. The method as claimed in claim 1, wherein zones of the first and second zone plates include Iridium.

8. The method as claimed in claim 1, further including a third zone plate mechanically stacked with the first and second zone plates.

9. The method as claimed in claim 8, further including a fourth zone plate mechanically stacked with the first, second, and third zone plates.

10. The method as claimed in claim 1, wherein the compound zone plate has a mark-to-space ratio of 1:1 in the outermost zones.

11. The method as claimed in claim 1, wherein fabricating the first zone plate and the second zone plate comprises using atomic layer deposition to deposit Gold zones.

12. The method as claimed in claim 1, wherein fabricating the first zone plate and the second zone plate comprises using atomic layer deposition to deposit Platinum zones.

13. The method as claimed in claim 1, wherein fabricating the first zone plate and the second zone plate comprises using atomic layer deposition to deposit Tungsten zones.

14. The method as claimed in claim 1, wherein fabricating the first zone plate and the second zone plate comprises using atomic layer deposition to deposit Iridium zones.

15. The method as claimed in claim 1, further comprising:

fabricating a third zone plate using atomic layer deposition to deposit zones on sidewalk of a third patterned resist template; and stacking the third zone plate with the first zone plate and the second zone plate to form the compound zone plate.

16. The method as claimed in claim 15, further comprising:

fabricating a fourth zone plate using atomic layer deposition to deposit zones on sidewalls of a fourth patterned resist template; and stacking the fourth zone plate with the first zone plate, the second zone plate, and the third zone plate to form the compound zone plate.

* * * * *